US011077454B2

(12) United States Patent
Vesely et al.

(10) Patent No.: US 11,077,454 B2
(45) Date of Patent: Aug. 3, 2021

(54) SPRAY PLUME SHAPING SYSTEM AND METHOD

(71) Applicant: Spraying Systems Co., Wheaton, IL (US)

(72) Inventors: Paul W. Vesely, Chicago, IL (US); Rudolf J. Schick, Forest Park, IL (US)

(73) Assignee: Spraying Systems Co., Wheaton, IL (US)

( * ) Notice: Subject to any disclaimer, the term of this patent is extended or adjusted under 35 U.S.C. 154(b) by 41 days.

(21) Appl. No.: 16/245,497

(22) Filed: Jan. 11, 2019

(65) Prior Publication Data

US 2019/0217316 A1 Jul. 18, 2019

Related U.S. Application Data

(60) Provisional application No. 62/616,862, filed on Jan. 12, 2018.

(51) Int. Cl.

| | |
|---|---|
| ***B05B 5/053*** | (2006.01) |
| ***B05B 5/043*** | (2006.01) |
| ***B05B 5/025*** | (2006.01) |
| ***B05B 5/057*** | (2006.01) |
| ***B05D 1/04*** | (2006.01) |

(52) U.S. Cl.

CPC ..... *B05B 5/0533* (2013.01); *B05B 5/0255* (2013.01); *B05B 5/043* (2013.01); *B05B 5/057* (2013.01); *B05B 5/0535* (2013.01); *B05D 1/04* (2013.01); *B05B 5/0531* (2013.01)

(58) Field of Classification Search

CPC ..... B05B 5/005; B05B 5/006; B05B 5/0255; B05B 5/035; B05B 5/043; B05B 5/0531; B05B 5/0533; B05B 5/0535; B05B 5/0536; B05B 5/057; B05B 5/087; B05B 5/088; B05D 1/04

USPC ..... 239/690, 690.1

See application file for complete search history.

(56) References Cited

U.S. PATENT DOCUMENTS

| | | | | | |
|---|---|---|---|---|---|
| 4,011,991 | A * | 3/1977 | Masuda | B05B 5/007 | 239/708 |
| 4,854,506 | A * | 8/1989 | Noakes | B05B 5/0255 | 239/691 |
| 5,584,931 | A * | 12/1996 | Buhlmann | B05B 5/032 | 118/300 |
| 2014/0367478 | A1* | 12/2014 | Roos | B05B 5/0255 | 239/3 |
| 2015/0251201 | A1* | 9/2015 | Hradetzky | B05B 5/1691 | 239/690 |
| 2018/0304283 | A1* | 10/2018 | Sato | B05B 5/0407 | |

* cited by examiner

*Primary Examiner* — Cody J Lieuwen

(74) *Attorney, Agent, or Firm* — Leydig, Voit & Mayer, Ltd.

(57) ABSTRACT

A system and method for shaping and/or directing a spray stream includes electrostatically charging a spray stream by exposing fluid to be sprayed to an electrical field within a fluid sprayer to create an electrostatically charged spray stream, and then creating an electrical field between secondary electrodes externally to the fluid sprayer such that the electrostatically spray stream is shaped and/or redirected as it passes through the electrical field.

20 Claims, 5 Drawing Sheets

SPRAY PLUME SHAPING SYSTEM AND METHOD

CROSS-REFERENCE TO RELATED APPLICATIONS

The instant application claims priority to U.S. Provisional Patent Application No. 62/616,862, which was filed on Jan. 12, 2018, the contents of which are incorporated herein in their entirety by reference.

BACKGROUND OF THE INVENTION

One known type of spraying technology includes spray nozzles that atomize the sprayed material to achieve a more uniform distribution and coverage. One type of spray atomization includes use of electrostatic atomization nozzles, which are part of a family of electro-hydrodynamic (EHD) nozzles that use two electrodes positioned very close together generating a very strong electric field. In such devices, one electrode has a very high voltage of negative polarity, and the other electrode is the nozzle body, which is electrically grounded. A dielectric fluid such as oil may pass between the two electrodes and through the very strong electric field they create, causing current to be injected into the fluid and, thus, electrically charging the liquid. The charged liquid exits the nozzle through a small circular orifice producing a solid stream of charged oil. Outside the nozzle, the excess charge in the liquid electrically repulse each other within the oil inducing a spin in the oil jet that results in bending instability and eventually necking, which causes the fluid to break up into droplets and, thus, atomize. As can be appreciated, the omnidirectional repulsive forces of electrons within the charged fluid cause the spray plume to assume a full cone shape as it develops. The sprayed particles are then attracted to grounded, conductive surfaces that are to be coated by the fluid sprayed.

BRIEF SUMMARY OF THE INVENTION

The invention provides a system and method for shaping a conical spray plume of charged droplets into, for example, a flat cone or fan shape. The very small orifice size required for this type of nozzle does not lend well to changing the orifice geometry to produce a flat spray, which is how sprays are typically shaped into a flat spray pattern. In one embodiment, the present disclosure utilizes an electrostatic spray nozzle, which produces a full cone plume. The full cone plume, which is made from charged fluid droplets, is subjected to a secondary electrical field, which can impose attractive or repulsive electrical forces onto the charged fluid droplets, thus affecting their trajectory and direction of travel as the plume develops. The intensity of the secondary electrical field may be constant or variable, and the shape of the secondary field electrodes is adjustable, such that steady or transient spray plume shaping can be achieved.

In one illustrated embodiment, a spray plume of charged droplets is subjected to an electric field. The electrical field squeezes the full cone spray into a flat fan. The electric field is generated by electrodes of negative polarity and produces a repulsive force on the negatively charged droplets forcing them to fan out.

BRIEF DESCRIPTION OF THE SEVERAL VIEWS OF THE DRAWING(S)

FIGS. 4-7 are schematic views of alternative embodiments for spray shaping electrodes for a spray nozzle in accordance with the disclosure.

DETAILED DESCRIPTION OF THE INVENTION

Figure 1:
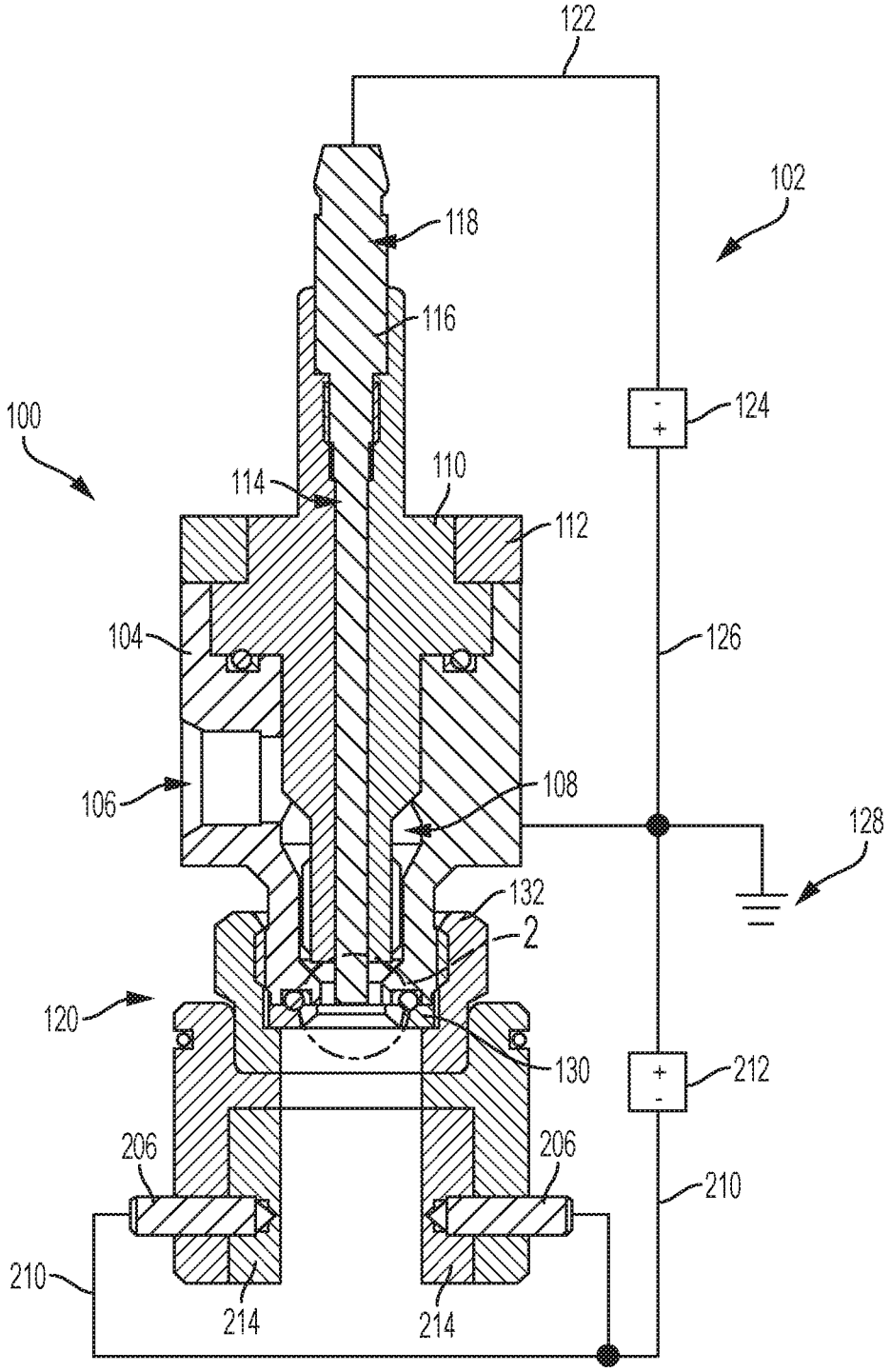
FIG. 1 is a section view of a spray nozzle in accordance with the disclosure.

A cross section view of a spray nozzle assembly 100 is shown in FIG. 1. The spray nozzle assembly 100 is associated with an electrical system 102 to provide a shaped spray plume, as will be described hereinafter. The spray nozzle assembly 100 in the illustrated embodiment is an assembly of various components that contain, direct, electrically charge and inject a spray plume. The spray nozzle assembly 100 includes a body 104 having a fluid inlet port 106. The body 104 forms an internal cavity 108 that has a stepped bore configuration and that contains and houses various other structures of the assembly, electrodes of the electrical system 102, and also fluid to be injected.

Figure 2:
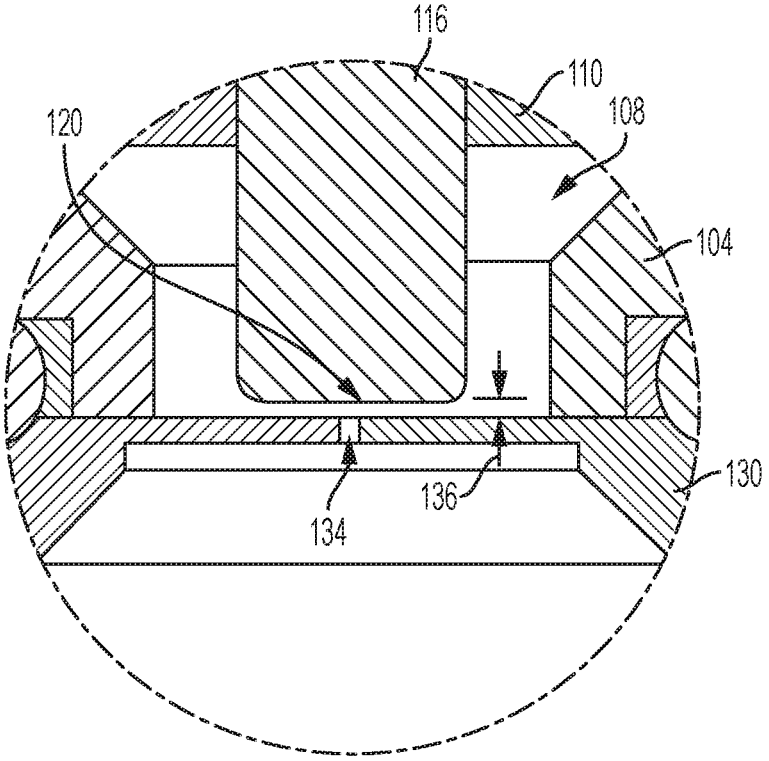
FIG. 2 is an enlarged detail view of a portion of FIG. 1.

In reference to FIG. 1, and also to the enlarged detail view shown in FIG. 2, the nozzle assembly 100 includes a spacer 110 having a generally cylindrical shape of differing diameters that is retained within the internal cavity 108 with a collar 112. The collar 112 may be attached to the body 104 using any appropriate fastening method such as screws or other fasteners, a threaded engagement between the collar and the body, and the like. The spacer 110 forms a central bore 114 into which a high-voltage electrode 116 is disposed. The high-voltage electrode 116 has a generally elongate shape that extends from a connector end 118 thereof to an exposed end 120. The connector end 118 protrudes externally relative to the spray nozzle assembly 100 and is configured to connect to an high-voltage electrical conductor 122 of a high-voltage electrical potential source 124. As shown in the arrangement of FIG. 1, the source 124 provides a negative electrical potential to the conductor 122, and also includes a positive conductor 126 connected to an earth ground 128 and also to the body 104. In this way, a high-voltage electrical potential difference is present between the high-voltage electrode 116 and the body 104 of the spray nozzle assembly 100.

The spacer 110 is made from a non-electrically conductive material and acts as an electrical insulator between the high-voltage electrode 116 and the body 104. Any appropriate and desired electrical potential difference may be applied at the source 124 depending on the type of fluid being sprayed. For example, oil and other industrial fluids may be sprayed using an electrical potential between −20 and −30 kV, while heavier fluids such as paint or agricultural applications may operate at a higher electrical potential between −60 and −75 kV. The fluids may be conductive, semi-conductive, or non-conductive. In the illustrated embodiment, the voltage provided by the source 124 is selected to be between −5 to −10 kV, but other values can also be used.

Figure 3:
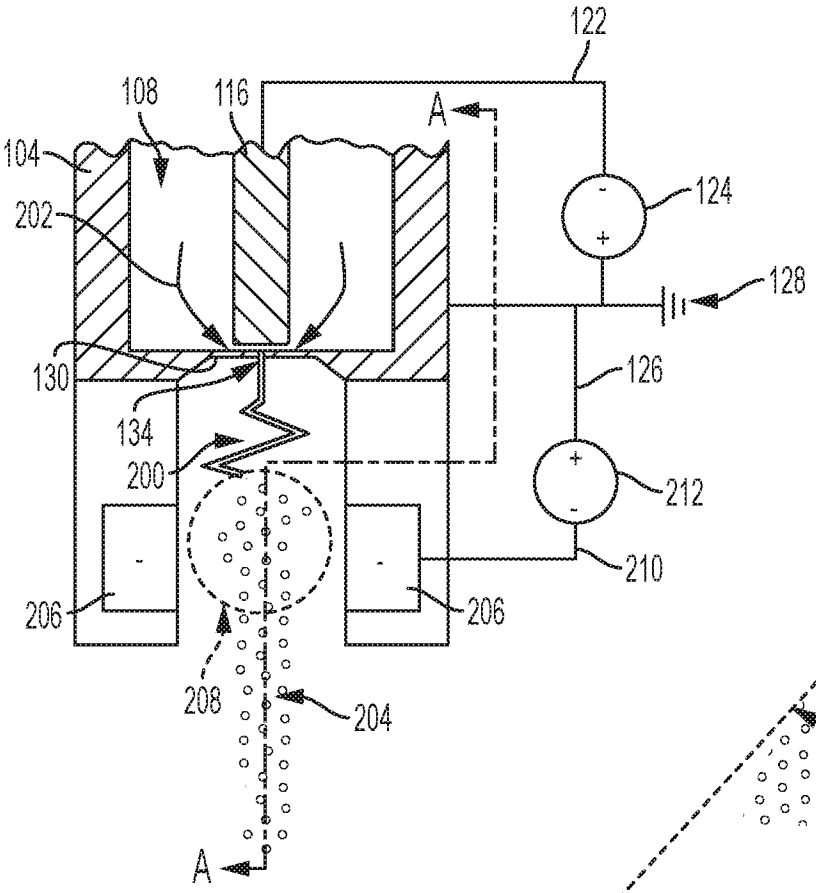

The exposed end 120 of the electrode 116 protrudes from an end of the spacer 110 and is immersed in, or contact with, fluid present and passing through the internal cavity 108. As can be seen in FIG. 2, an orifice plate 130 is retained at one end of the body 104 by a retainer 132 and effectively closes an open end of the internal cavity 108 opposite the collar 112. The orifice plate is in physical contact with and, thus, in electrical contact with the body 104 when the body 104 and plate 130 are made of electrically conductive materials such as metal, as is the case in the illustrated embodiment. The orifice plate 130 also includes an orifice opening 134, through which fluid present and passing through the internal cavity 108 can exit the nozzle assembly 100 and be injected as a spray stream 200, as shown in FIG. 3. FIG. 3 represents a schematical representation of the nozzle assembly 100 in an operating condition, in which structures and features that are the same or similar to corresponding structures and features discussed above are denoted by the same reference numerals as previously used for simplicity.

As shown in FIG. 2, the exposed end 120 of the high-voltage electrode 116 is disposed at an offset distance from the orifice plate 130 such that a gap 136 remains between the exposed end 120 and the orifice plate 130. During operation, fluid present within the internal cavity 108 flows through the internal cavity 108 from the inlet 106 (FIG. 1) and towards the orifice opening 134 under a pressure differential, which can be referred to as an injection pressure. When fluid reaches the orifice opening 134, it accelerates as it passes through the relatively small cross sectional flow area of the orifice opening 134 and emerges on an outer side of the orifice plate 130 as the spray stream 200. As the fluid, which is denoted in FIG. 3 as 202 and represented by arrows, passes through the internal cavity 108 and especially through the gap 136, the electrical potential difference between the high-voltage electrode 116 and the orifice plate 130 causes electrical charge to pass into or through the fluid stream 200 such that the fluid stream 200 that emerges from the nozzle assembly 100 is electrostatically charged. In the illustrated embodiment, a negative charge is used to charge the fluid that emerges as a spray stream from the nozzle assembly 100. Ordinarily, the charged spray stream 200 would break up into a conical spray plume owing to the electrically repulsive forces of electrons within the sprayed fluid, which would cause fluid droplets to be formed and repulse one another in all directions as the plume develops.

Figure 8:
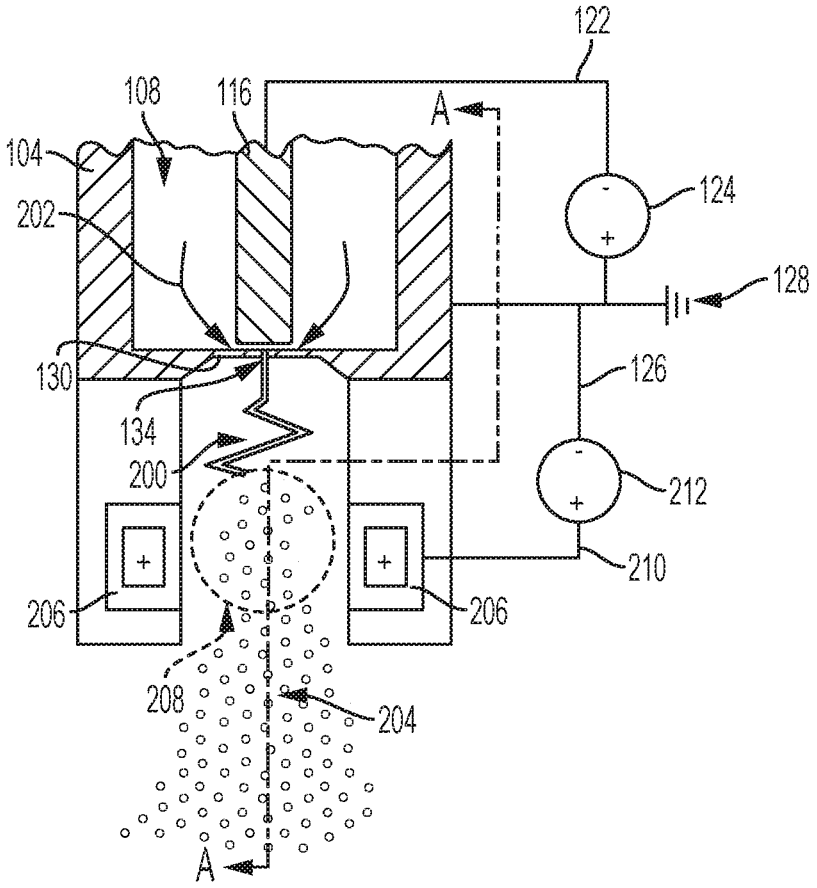
FIG. 8 is a schematic view of the spray nozzle in accordance with an alternative embodiment.

In the illustrated embodiment, a set of secondary electrodes 206 is disposed around an area 208 that encompasses the spray stream 200 shortly after it emerges from the orifice opening 134. Although a set of secondary electrodes is shown, it should be appreciated that at least one secondary electrode can be used, in which case the area 208 would be an area surrounding a single secondary electrode in which an electric field created by the secondary electrode would be present. The area 208 may be selected to include the distance in which the spray stream 200 begins or has begun to break up into droplets that would otherwise have begun to form a conical spray plume. The secondary electrodes 206 (two shown) are disposed at diametrically opposite locations around the nozzle body 104 and are connected to a secondary voltage source 212 of electrical potential through a conductor 210. While the secondary voltage source 212 has a negative pole connected to the electrodes 206 and a positive pole connected to the earth ground 128, as shown in the figures, it should be appreciated that the polarity of one or both voltage sources may be reversed. Further, in the case of a single secondary electrode, the secondary voltage source 212 may be connected across the single secondary electrode, using its negative or positive pole, and an electrical ground. For example, the voltage source 124 may have a negative pole connected to the electrode 116, as shown in FIG. 1, but the secondary voltage source 212 may have a positive pole connected to the secondary electrode(s) 206, as shown in FIG. 8, which would operate to attract, rather than repel, the droplets of the spray that emerges from the orifice 134 to create a more spread-out fan spray. In another alternative embodiment, the voltage sources 124 and 212 may be combined into a single voltage source that share an electrical ground.

When the secondary voltage source 212 is active, in the polarity shown in FIG. 3, a negative electrical potential is present at the electrodes 206, which together create a static electrical field at least over a portion of the area 208. The negative electrical potential field generated by the secondary electrodes 206 repulses the negatively charged spray droplets and urges them away from each of the two electrodes 206 such that the droplets generally tend to travel at about the midpoint of the distance between the two electrodes 206, as shown in FIG. 3. In alternative embodiment, a positive electrical potential field created by positively charged secondary electrodes 206 will tend to attract fluid droplets and spread them further apart from one another in a wide fan spray.

Figure 4:
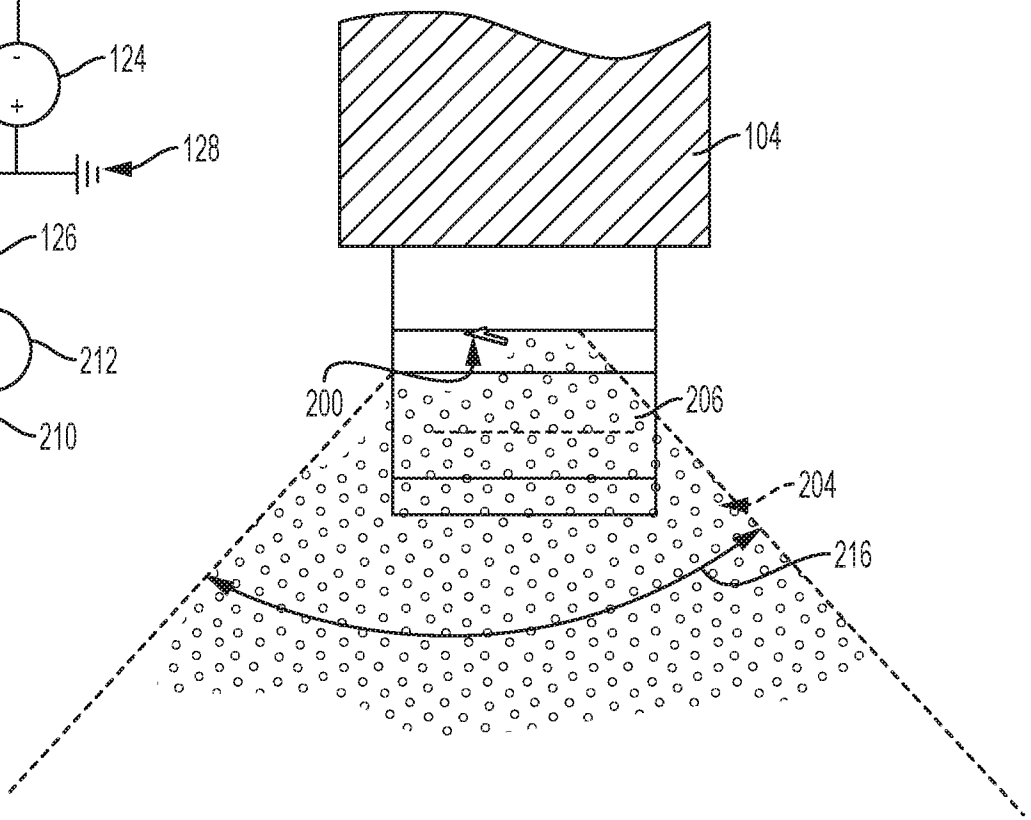
FIGS. 3 and 4 are schematic views of the spray nozzle shown in FIG. 1 during operation and from different perspectives.

These additional repulsive or attractive electrostatic forces provided by the secondary electrode(s) act to collapse or expand, as the case may be, the conical spray plume into a wide or flat fan spray plume 204. A flat fan spray plume 204 is shown in FIG. 4 from a side perspective for illustration of one embodiment. A wide fan spray plume 204 is shown in FIG. 8 in accordance with an alternative embodiment. As can be seen in FIG. 4, the fan spray plume 204 sweeps across a sweep angle 216, the size of which can selectively adjusted by controlling various system parameters such as injection pressure, the amount of the low- and high-voltage electrical potentials, the type of fluid, the distance between the electrodes 206, the size of the electrodes 206, the shape of the electrode(s) 206, the polarity of the electrode(s) 206, and other parameters.

Figure 7:
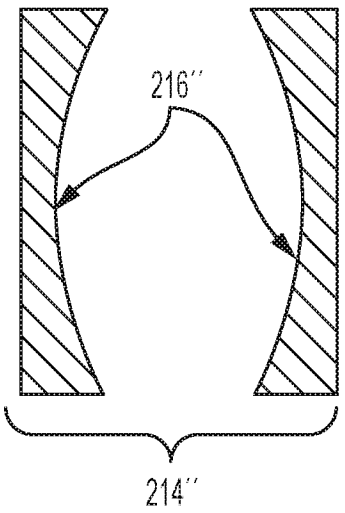
Figure 6:
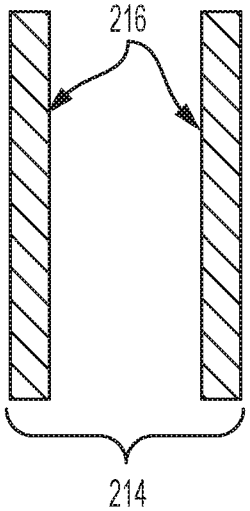
Figure 5:
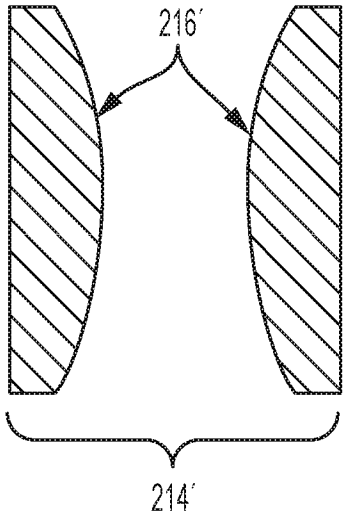

For illustration, three alternative shapes for shaped electrode leads 214, as shown in FIG. 1, are presented in FIGS. 5, 6, and 7. These shapes can be embodied into a single or multiple secondary electrode(s). In this illustration, electrode leads 214 having flat inner-facing surfaces 216 such as those illustrated in the embodiment of FIG. 1 are shown in FIG. 6. The flat inner-facing surfaces can apply a uniform repulsive force onto the spray plume and cause the same to fan uniformly as it develops. In FIG. 5, electrode leads 214' having convex inner-facing surfaces 216' are shown. Similarly, in FIG. 7, electrode leads 214" having concave inner-facing surfaces 216" are shown. The concave or convex profile of the inner-facing surfaces can affect the intensity of the electrostatic repulsive forces onto the spray droplets as the spray plume develops, which can further serve to shape the otherwise conical plume into a more spread out or more focused fan, i.e., a fan plume having a larger sweep angle or a smaller sweep angle, the apex of which can also be different.

For example, in the embodiment of FIG. 5, the sweep angle may be larger and its apex further away from the orifice opening as the developing droplets pass through a higher intensity field present halfway down the path between the electrodes 214' where the inner-facing surfaces 216' are closest to one another. Similarly, the sweep angle may be smaller and its apex closer to the orifice opening as the developing droplets pass through higher intensity fields present at the entry and exit points of the area between the electrodes 214" where the inner-facing surfaces 216" are closest to one another. Other shapes, or more than two electrodes disposed around a developing cone plume can also be used to shape the plume. Moreover, it is contemplated that a single electrode can also be used to shape a portion of the otherwise conical developing plume, for example, into a half-circle.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A spray nozzle assembly, comprising:

a body having a fluid inlet port and a fluid output orifice, the body defining an internal cavity in fluid communication with the fluid inlet port and the fluid output orifice, the body being electrically connected to an earth ground;

a primary electrode disposed within the internal cavity proximal to the fluid output orifice, the primary electrode being electrically isolated from the body;

at least one secondary electrode disposed externally to the body;

a primary voltage source connected across the primary electrode and the body such that a primary voltage difference is present between the primary electrode and the body; and a secondary voltage source connected to the at least one secondary electrode such that a secondary voltage of a same polarity as the primary electrode is present at the at least one secondary electrode that creates a secondary voltage difference between the at least one secondary electrode and the body, which induces an electric field in an area around the at least one secondary electrode;

wherein, during operation, the primary voltage difference is adapted to impart a primary electrostatic charge onto fluid passing through the internal cavity in contact with the primary electrode and the body and exiting the internal cavity through the fluid output orifice as a spray stream comprising charged spray droplets; and wherein the electric field is adapted to shape the spray stream as it passes through at least a portion of the electric field by electrically repulsing the charged spray droplets, the electric field being selectively adjustable in intensity to selectively shape or redirect the spray stream in response to the selective adjustment of the intensity of the electric field.

2. The spray nozzle assembly of claim 1, wherein the primary electrode has an elongate shape extending between an exposed end disposed at an offset distance from the fluid output orifice and a connector end that extends externally relative to the body.

3. The spray nozzle assembly of claim 2, further comprising a collar made from an electrically insulating material, the collar disposed between the primary electrode and the body to mount the primary electrode within the internal cavity.

4. The spray nozzle assembly of claim 1, wherein the primary voltage source is configured to generate a voltage difference potential of about −5 to −75 kV depending on a type of fluid passing through the internal cavity.

5. The spray nozzle assembly of claim 1, wherein the primary voltage source has a negative pole connected to the primary electrode and a positive pole connected to the body and an electrical ground.

6. The spray nozzle assembly of claim 1, wherein the body is made from an electrically conductive material in an area around the fluid output orifice.

7. The spray nozzle assembly of claim 1, further comprising an additional secondary electrode that, together with the at least one secondary electrode make a pair of secondary electrodes, the pair of secondary electrodes disposed in opposed relation around at least a portion of the spray stream at diametrically opposite locations around the body and are both connected to a same voltage potential of the secondary voltage source.

8. The spray nozzle assembly of claim 7, wherein the pair of secondary electrodes have flat inner-facing surfaces in opposed relation.

9. The spray nozzle assembly of claim 1, wherein a voltage polarity of the at least one secondary electrode acts to flatten a shape of a plume produced by repelling at least a portion of the charged spray droplets of the spray stream.

10. The spray nozzle assembly of claim 1, wherein the primary voltage source and the secondary voltage source are electrically connected to the earth ground.

11. The spray nozzle assembly of claim 1, wherein the at least one secondary electrode has a concave or a convex surface facing the spray stream.

12. A spray nozzle assembly, comprising:

a body having a fluid inlet port and a fluid output orifice, the body defining an internal cavity in fluid communication with the fluid inlet port and the fluid output orifice, the body being electrically connected to an earth ground;

a primary electrode disposed within the internal cavity proximal to the fluid output orifice, the primary electrode being electrically isolated from the body and having an exposed end disposed within the internal cavity and a connector end protruding externally from the body;

a plurality of secondary electrodes disposed externally to the body, the plurality of secondary electrodes disposed in opposed relation to one another to create a space therebetween, the space located such that a spray stream emitted through the fluid output orifice passes through the space between the plurality of secondary electrodes;

a primary voltage source connected across the primary electrode and the body such that a primary voltage difference is present between the primary electrode and the body; and a secondary voltage source connected across the plurality of secondary electrodes and the body such that a secondary voltage difference is present between the plurality of secondary electrodes that creates an electric field extending across the space between the plurality of secondary electrodes;

wherein, during operation, a primary electrostatic charge is imparted onto fluid passing through the internal cavity in contact with the primary electrode and the body and exiting the internal cavity through the fluid output orifice as a spray stream comprising charged spray droplets; and wherein the electric field possesses a same polarity as the charged spray droplets and is selectively adjustable in intensity to shape or redirect the spray stream by electrostatically repulsing the charged spray droplets in response to the selective adjustment of the intensity of the electric field.

13. The spray nozzle assembly of claim 12, further comprising a collar made from an electrically insulating material, the collar disposed between the primary electrode and the body to mount the primary electrode within the internal cavity.

14. The spray nozzle assembly of claim 12, wherein the primary voltage source has a negative pole connected to the primary electrode and a positive pole connected to the body and the earth ground.

15. The spray nozzle assembly of claim 12, wherein the plurality of secondary electrodes have flat inner-facing surfaces in opposed relation.

16. The spray nozzle assembly of claim 12, wherein the plurality of secondary electrodes have concave or convex inner-facing surfaces in opposed relation.

17. A method for shaping a spray stream provided through a spray nozzle assembly, comprising:

providing a body having a fluid inlet port and a fluid output orifice, the body defining an internal cavity in fluid communication with the fluid inlet port and the fluid output orifice, the body being electrically connected to an earth ground;

providing a primary electrode disposed within the internal cavity proximal to the fluid output orifice, the primary electrode being electrically isolated from the body;

providing a secondary electrode disposed externally and electrically isolated from the body;

connecting a primary voltage source across the primary electrode and the body such that a primary voltage difference is present between the primary electrode and the body;

electrostatically charging fluid emitted through the fluid output orifice as a spray stream by passing fluid through the internal cavity and in contact with the primary electrode and the body, wherein the spray stream includes charged spray droplets;

providing a secondary voltage source connected across the secondary electrode and the body;

creating an electric field in a space around the secondary electrode, the electrical field having a same polarity as the primary electrode and the charged spray droplets;

directing the spray stream through at least a portion of the electric field; and selectively adjusting an intensity of the electric field to selectively repulse the charged spray droplets and thus shape or redirect the spray stream.

18. The method of claim 17, wherein the primary voltage source has a negative pole connected to the primary electrode and a positive pole connected to the earth ground.

19. The method of claim 17, wherein a polarity of the electric field acts to repel at least a portion of the spray stream.

20. The method of claim 17, wherein an intensity of the electric field acts to flatten a shape of a plume produced by the spray stream.

* * * * *